US005771849A

United States Patent [19]

Hamy

[11] Patent Number: 5,771,849

[45] Date of Patent: Jun. 30, 1998

[54] INTERNAL COMBUSTION ENGINE WITH CRANKCASE PRESSURE BARRIER

[76] Inventor: Norbert Hamy, 236 The Kingsway, Etobicoke, Ontario, Canada, M9A 3T5

[21] Appl. No.: 713,222

[22] Filed: Sep. 12, 1996

Related U.S. Application Data

[60] Provisional application No. 60/003,796 Sep. 15, 1995.

[51] Int. Cl.[6] ..... F02B 33/12

[52] U.S. Cl. ..... 123/73 R; 123/74 AE

[58] Field of Search ..... 123/73 R, 73 B, 123/74 AE, 74 AC, 74 D

[56] References Cited

U.S. PATENT DOCUMENTS

| | | | |
|---|---|---|---|
| 1,740,235 | 12/1929 | Fogas | 123/74 AE |
| 1,977,657 | 10/1934 | Watson | 123/74 D |
| 2,215,793 | 9/1940 | Mayes . | |
| 2,564,913 | 8/1951 | Mead | 123/74 D |
| 3,003,486 | 10/1961 | Werner | 123/74 D |
| 3,356,080 | 12/1967 | Howard | 123/73 R |
| 4,506,636 | 3/1985 | Negre et al. | 123/65 VC |
| 4,813,387 | 3/1989 | Prevedel et al. | 123/73 B |
| 4,934,345 | 6/1990 | Fukuoka et al. | 123/73 PP |
| 4,936,269 | 6/1990 | Beaty | 123/74 AE |

FOREIGN PATENT DOCUMENTS

| | | |
|---|---|---|
| 42 05 663 | 8/1993 | Germany . |
| 12 006 | 12/1924 | Netherlands . |

*Primary Examiner*—David A. Okonsky
*Attorney, Agent, or Firm*—Marks & Clerk

[57] ABSTRACT

An internal combustion engine includes a cylinder, a crankcase, a crankshaft rotatable in the crankcase, a piston, and a connecting rod supporting the piston for reciprocating movement in the cylinder and mounted on the crankshaft. A barrier member extends around the connecting rod to sealingly separate the cylinder from the crankcase. The barrier member is laterally displaceable to provide for angular motion of the connecting rod as the piston reciprocates in the cylinder.

18 Claims, 20 Drawing Sheets

INTERNAL COMBUSTION ENGINE WITH CRANKCASE PRESSURE BARRIER

BACKGROUND OF THE INVENTION

This application claims the benefit under 35 U.S.C. Section 119(e) of my co-pending provisional application Ser. No. 60/003,796 filed on Sep. 15, 1995.

This invention relates to reciprocating internal combustion engines, and particularly, but not exclusively, to two-stroke engines.

Two-cycle engines are old in the art of power-plant design. The high power output per displacement and weight efficiency due to the fact that every alternate stroke is a power stroke make two-stroke engines an attractive solution. Unfortunately, most two-cycle engines utilize a fuel/oil mixture (example ratio: 20:1) to facilitate lubrication of necessary engine components. This feature has always given the two-cycle dirty-burn qualities and has prevented the engine from becoming a serious contender in the mainstream automotive industry.

Most recent two-cycle engines employ "loop scavenging" with the intake air being pumped through the crankcase. The incoming air is controlled by reed valves, rotary valves, or disk valves mounted in the crankcase wall. Exhaust ports may be fitted with a rotary valve to adjust the scavenging pulse relative to a specific RPM range, to improve breathing efficiency.

Recent efforts to clean up the two-cycle engine have included direct fuel injection, with separate lubricating provision. However, incoming air still flows through the crankcase and becomes contaminated with oil particles. To overcome this problem inherent with crankcase scavenging some manufacturers have promoted various methods of external scavenging such as: superchargers; turbochargers; secondary piston/cylinders. External scavenging can keep the intake air clean (air avoids crankcase), but the external pumping equipment used to charge the working cylinders leads to great complexity, a fact that defeats the primary attraction of the two-cycle engine.

An object of the invention is to retain the inherent simplicity of the two-cycle engine (few moving parts ) while mitigating the effects of the primary weak points, namely fuel/oil mixing, intake air flowing though crankcase, roller bearings (mains & big ends), breathing limitations of loop scavenging, and relatively low pressure of intake charge.

SUMMARY OF THE INVENTION

According to the present invention there is provided an internal combustion engine comprising a cylinder having a cylinder wall and a longitudinal axis; a crankcase; a crankshaft rotatable in said crankcase; a piston mounted on a connecting rod supporting said piston for reciprocating movement in said cylinder, said connecting rod being mounted on said crankshaft; a barrier member extending around said connecting rod to sealingly separate said cylinder from said crankcase throughout a complete crankshaft cycle, said barrier member being laterally displaceable to provide for angular motion of the connecting rod as said piston reciprocates in said cylinder; an intake port including a non-return valve located above said barrier member, said intake port leading to a first space below said piston; a row of transfer ports circumferentially spaced around said cylinder wall to establish communication between said first space and a second space above said piston over a limited range of the piston stroke such that intake air drawn through said intake port is first compressed in said first space during the downstroke of the piston and subsequently enters said second space through said transfer ports and to collide in the center of the cylinder and form a turbulent vertical air column above said piston; and an overhead rotary exhaust valve offset relative to said longitudinal axis.

The barrier member is preferably in the form of a laterally slidable plate attached to the connecting rod by a pivoting sealing collar, which the socket of a socket-and-ball coupling, the ball being formed on the connecting rod.

A shallow recess may be formed in the wall of the engine between the crankcase and cylinder, with the plate being slidably located in the shallow recess to permit its lateral movement.

Preferably, the engine includes an intake port for the intake of air into a space in the cylinder below the piston and above the barrier member, a non-return valve in the intake port, and transfer channels establishing communication between said space and a combustion chamber above the piston. Intake air drawn through the intake port on the upstroke is compressed and forced upward through said transfer ports to the combustion chamber on the downstroke.

The transfer channels may be grooves extending up the lower portion of the cylinder wall and which are closed off by the piston as it reaches a certain point on the upstroke.

The engine may also include a timed overhead rotary valve so that the compressed intake air scavenges burned gases in the combustion chamber on the upstroke.

BRIEF DESCRIPTION OF THE DRAWINGS

The invention will now be described in more detail, by way of example, only with reference to the accompanying drawings, in which.

DESCRIPTION OF THE PREFERRED EMBODIMENTS

Figure 1:
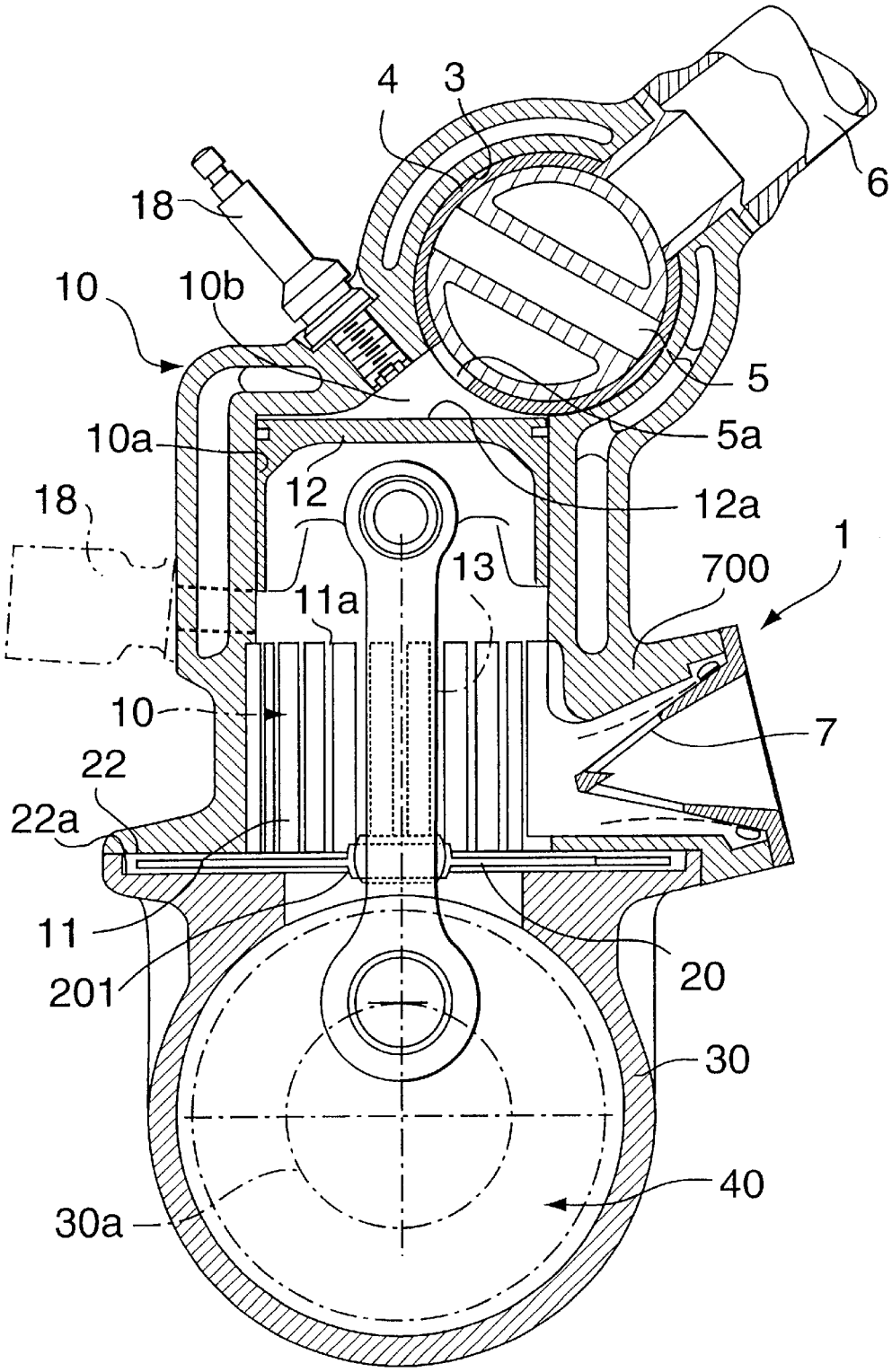
FIG. 1 is a vertical cross section through an engine block with the piston at top dead center (TDC) in accordance with a first embodiment of the invention.

Referring now to FIG. 1, the engine block 1 has a cylinder 10 with a cylinder wall 10*a*. The top portion of the block 1 contains a cylindrical sealing grid retaining sleeve 3, which lies across the cylinder. A rotary valve 4 with transverse port 5 is located in the retaining sleeve 3 to connect combustion chamber 10*b* to exhaust port 6 when the transverse port 5 comes into alignment with opening 5*a* in the sleeve 3 as the rotary valve rotates.

Figure 2:
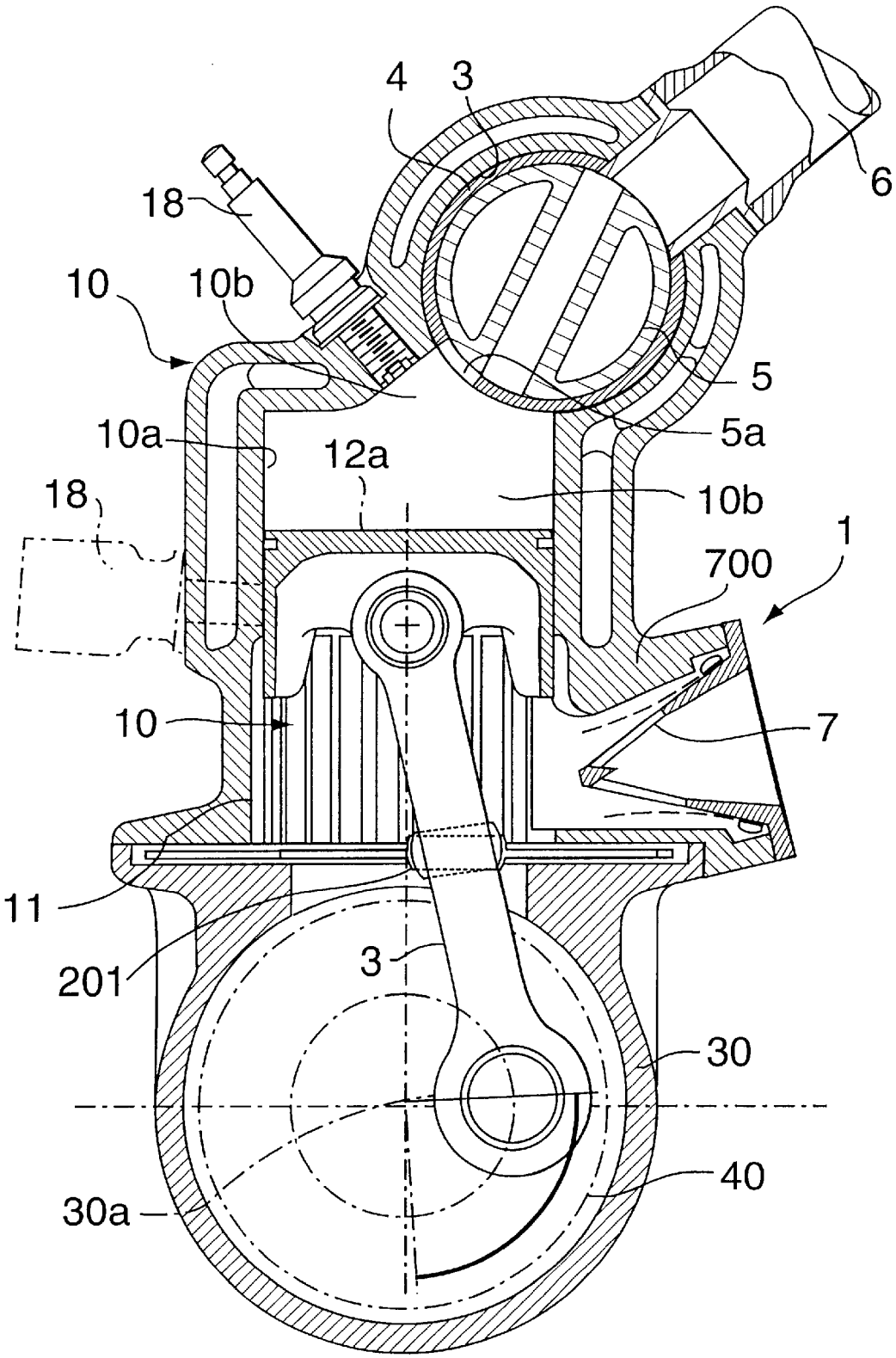
FIG. 2 is a vertical cross section of the engine block of the first embodiment with the piston at 85° crank angle.

FIG. 1 shows piston 12 at top dead center (TDC). As the piston 12 travels downward during combustion the rotary valve 4, which turns at half crank-speed, begins to open at crank angle 85° (FIG. 2). This allows the exhaust gases in the combustion chamber 10*b* to quickly evacuate through the rotary valve port 5. By bottom dead center (FIG. 3), the port 5 has again closed, allowing the gases again to be compressed in cylinder space 10*b* above the piston 12.

The upper portion of-the engine block 1 is separated from the crankcase 30 by a shallow recess 22*a*, which contains the membrane barrier case 22 containing the membrane barrier 20.

The cylindrical connecting rod (conrod) 13 is embraced by the sliding membrane 20, which sealingly separates the space 10*c* below piston 12 in cylinder 10 from the space 40 in the crankcase 30 containing crankshaft diagrammatically represented by circle 30*a*. The membrane 20 is preferably a thin (for example, 0.006") stainless steel sheet.

Figure 16:
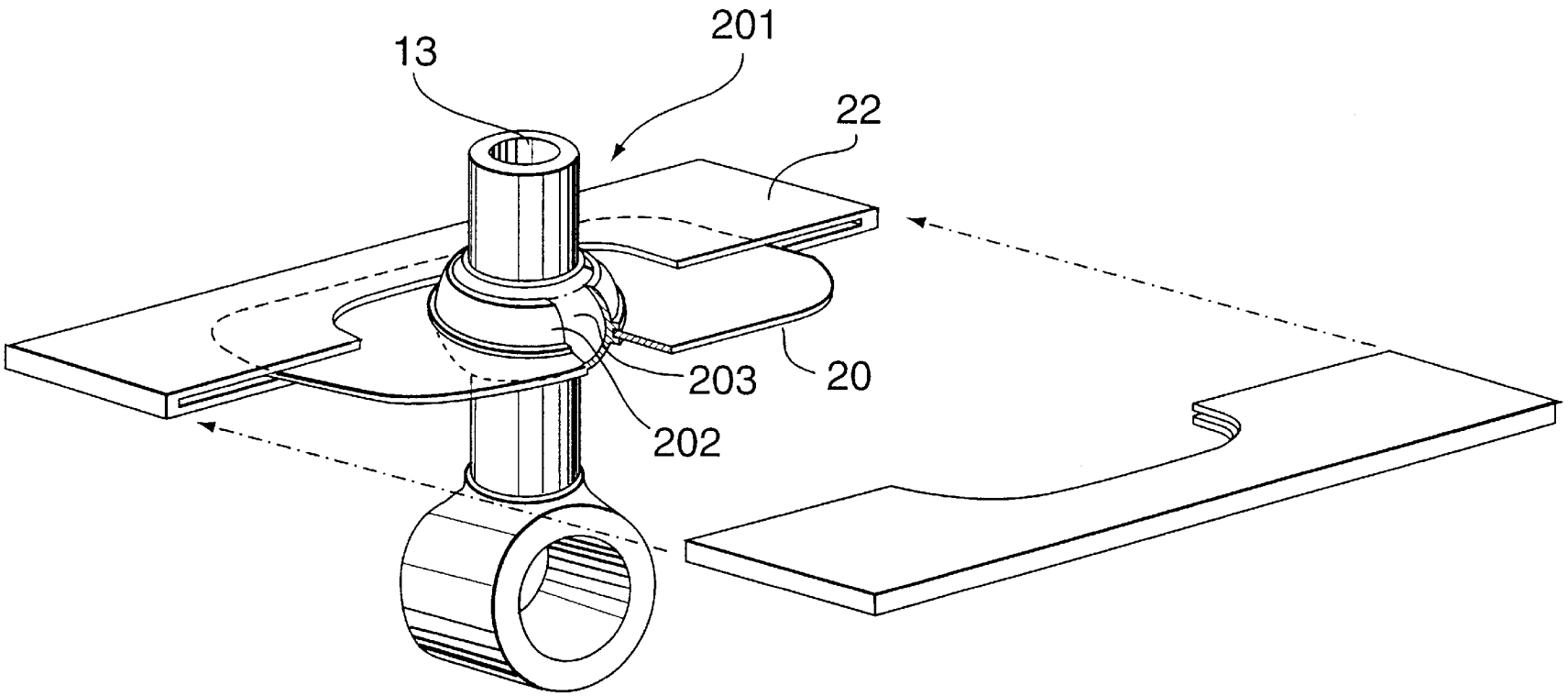
FIG. 16 is a perspective view of a membrane barrier module (longitudinal split)

The membrane 20 is coupled to the conrod 13 by an integral spherical sealing socket and ball collar 201, shown in more detail in FIG. 16. The collar 202 integral with the membrane 20 slidingly encases a part-spherical ball 203 mounted on the conrod 13 so as to allow pivoting of the conrod 13 relative to the membrane 20 as the membrane 20 slides laterally back and forth in its casing 22, which is preferably aluminum. The sliding membrane system thus allows for the angular motion of the connecting rod 13, while providing a pressure barrier between the intake space 10*c* (below the piston) and the crankcase space 40.

Figure 3:
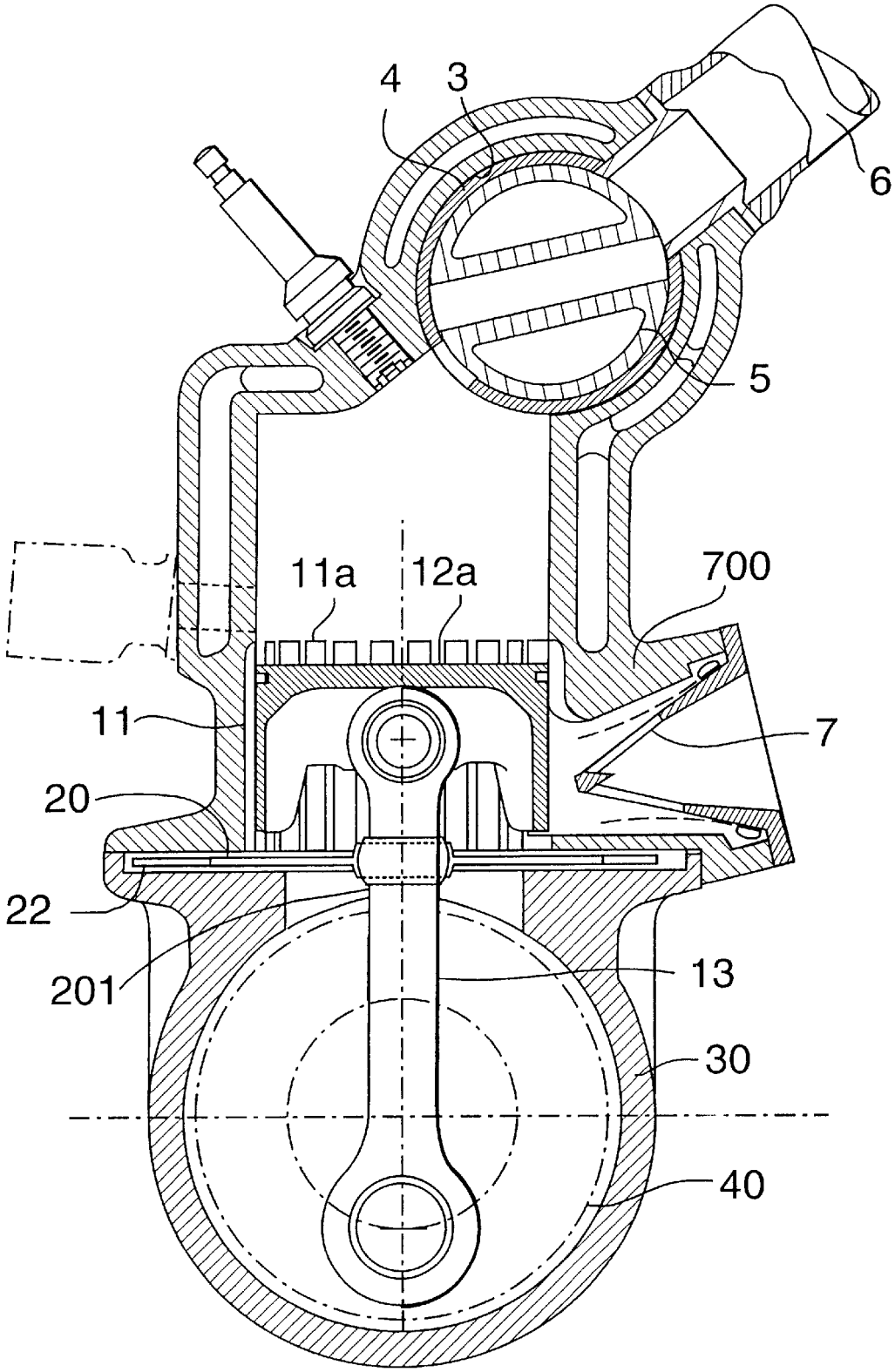
FIG. 3 is a vertical cross section of the engine block of the first embodiment with the piston at bottom dead center (BDC)
Figure 4:
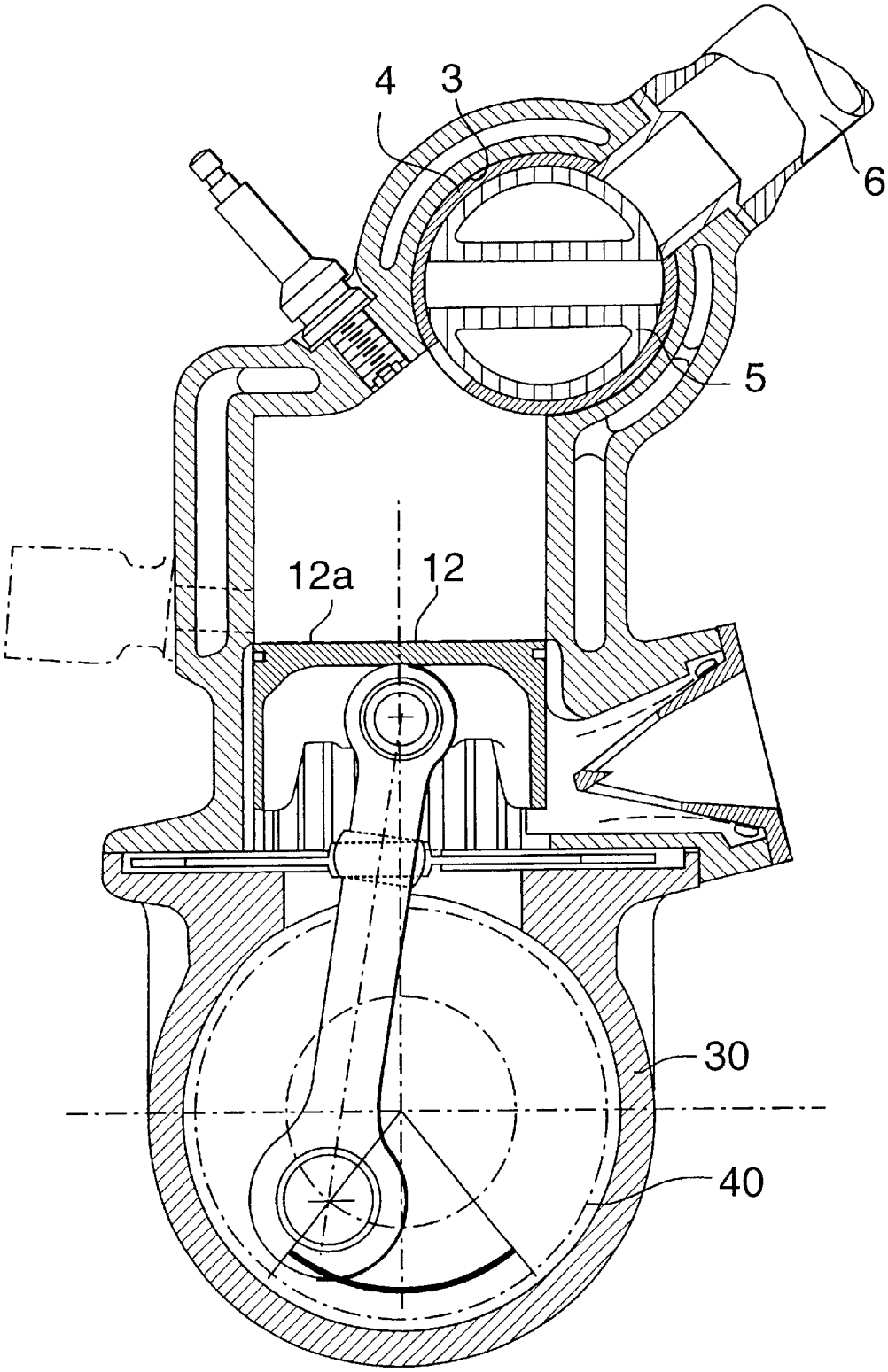
FIG. 4 is a vertical cross section of the engine block of the first embodiment with the piston at 221° crank.

Transfer ports 11 in the form of rectangular channels are formed in the wall 10*a* of the cylinder between the membrane barrier 20 and a point just above intake port 700. The transfer ports establish communication between the space 10*c* below the piston and the space 10*b* above the piston when the piston crown 12*a* lies below the top of the ports 11*a* (FIG. 3).

The air intake port 700 extends into the space 10*c* and includes a reed valve 7 serving as a non-return valve so as to permit air to be drawn into the cylinder space 10*c* on the upstroke of the piston 12, but to prevent it from flowing out on the subsequent downstroke.

The lubrication system in the crankcase space 40 is a conventional oil pressure system (dry or wet sump). The intake air flowing through the reed valve 7 remains uncontaminated by oil. The intake air is clean and not mixed with fuel. Fuel is injected by accurately controlled pulse through injector 6 after transfer ports 11 and exhaust valve 4 are closed, when the piston 12 is at a crank angle of 221° at which point the piston crown 21*a* lies in the same plane as the top of the transfer ports 11.

The injected fuel spray from fuel injector 18 passes across the hot piston crown, which causes very rapid atomization of the fuel. This arrangement prevents unburned fuel particles from escaping into the exhaust port. As the piston descends it compresses the clean inhaled air below the piston against the membrane crankcase barrier 22 at a 2:1 ratio, or more. This is approximately four or five times more scavenge pressure than a conventional-crankcase-compression two-cycle engine. This highly pressurized intake air allows for very shallow transfer-port openings above the piston rim 12*a*, because the flow velocity is extremely high.

Figure 5:
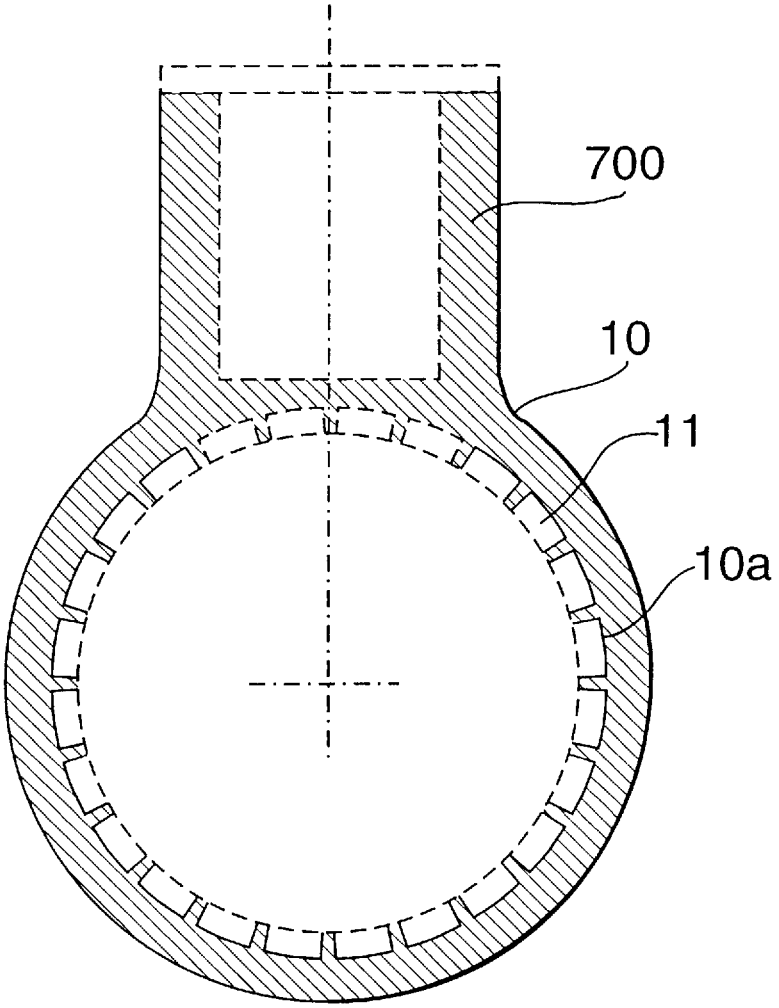
FIG. 5 is horizontal cross section through the intake space below the piston for the first embodiment.

As can be seen in more detail in FIG. 5, the vertical transfer ports 11 are shallow channels evenly spaced around the cylinder wall. This provides even, efficient, high-velocity airflow into the combustion chamber during the latter part of the downstroke and the first part of the upstroke. This high-velocity airstream collides in the centre of the cylinder above the piston, forming a turbulent vertical air column, which rapidly scavenges the exhaust gases in a linear upward fashion through the exhaust port 5.

Since all oil lubrication is confined to the crankcase 30 and does not contaminate the air/fuel mixture, the cylinder walls and pistons are lubricated by using self-lubricating materials, augmented by a film of fuel vapor. Proven metal-matrix alloys and surface coatings are available to perform these functions.

The cylinder wall can be an alloy casting, or a metal matrix casting, for example, aluminum containing ceramic compound, such as silicon carbide. The cylinder wall surface is coated with a coating, such as NCC (Nickel-Phosphorus based ceramic composite), which creates a superhard surface with self-lubricating characteristics. The piston sidewalls can be similarly treated. Low friction between these sliding surfaces is further enhanced by atomized fuel particles. No oil film is required.

Figure 6:
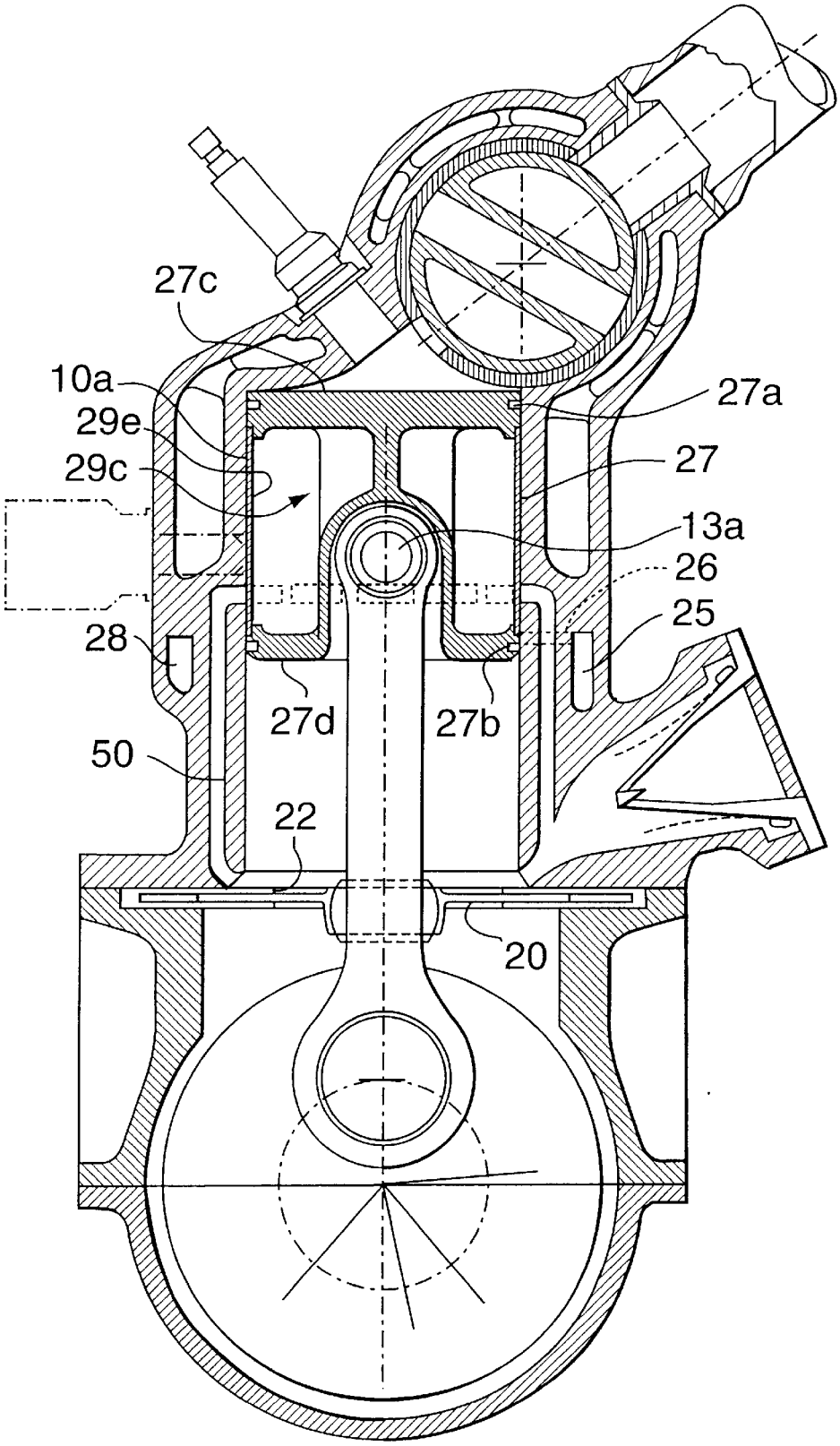
FIG. 6 is a vertical cross section through an engine block with the piston at top dead center (TDC) in accordance with a second embodiment of the invention.

The second embodiment shown in FIG. 6 has a cylinder wall 10*a* containing transfer slots 50, which continue inside the cylinder block as narrow transfer ducts 50 down to the intake space above the membrane barrier case 22. This embodiment has a smooth cylinder surface 10*a*, which is interrupted only by the narrow transfer slots 50 and several small oil-vapor orifices 26. The oil vapor orifices 26 feed pulsed lubricant to a double-faced piston 27. The oil-vapor orifices 26 are connected to an annular oil vapor vent space 25, which feeds back to the oil sump.

Figure 11:
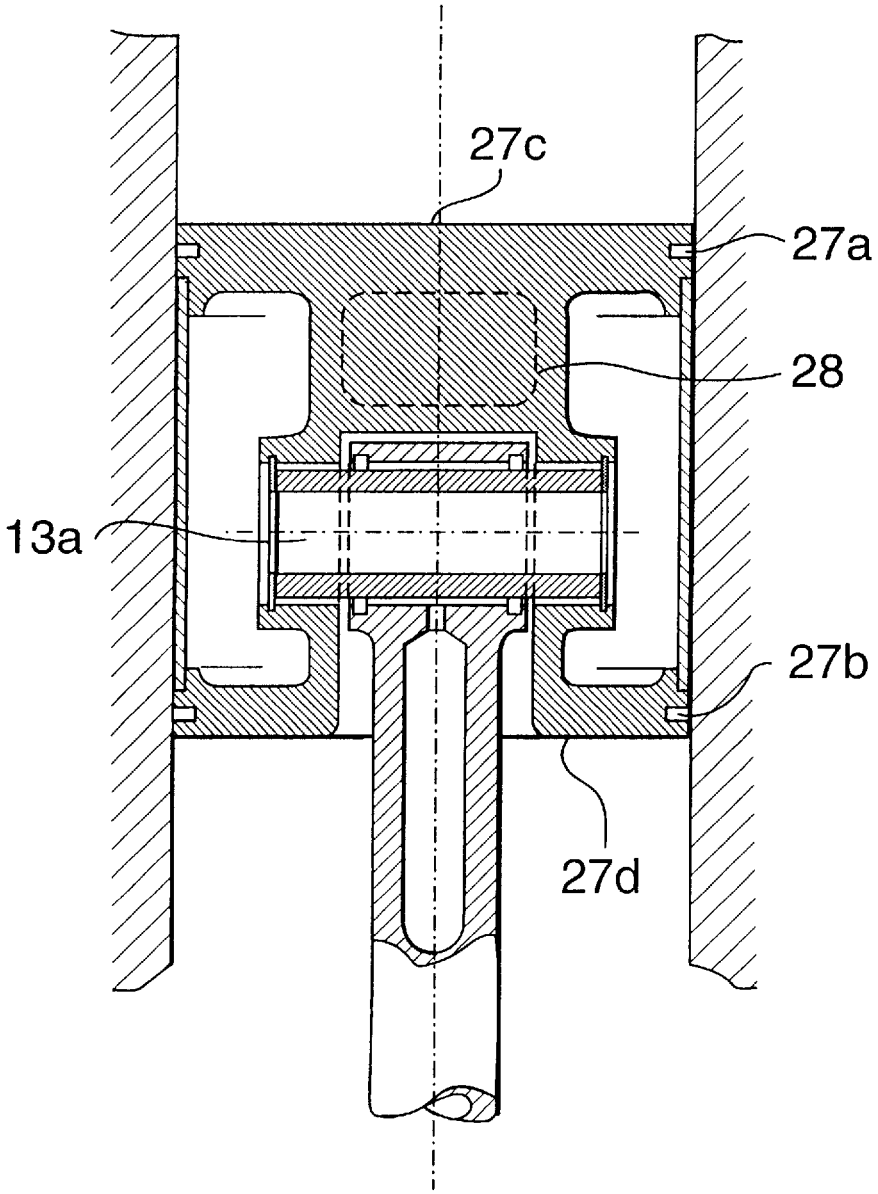
FIG. 11 is a transverse section of the piston and wrist-pin of the second embodiment.

The double-faced piston carries a top and bottom seal ring 27*a* and 27*b* in its crown plate and base structure (FIG. 11).

The crown and bottom plate are connected by a tubular web structure 27*c*, which also provides twin bores to carry the piston wrist-pin 13*a*. The space between crown plate 27*a* and bottom plate 27*d* of piston 27 is closed by a sprung split sleeve 28, which is set into respective ledges in the piston structure. This provides a smooth outer piston surface between top and bottom seal rings 27*a* and 27*b*, which contain the pulsed lubricant vapor. The pulsed oil-vapor is always retained between top and bottom rings, and thus does not contaminate the combustion chamber or the air intake space with oil.

The bottom plate 27*d* of the piston 27 compresses the ingested intake air against the membrane barrier 20 at a 6:1 ratio (net 5 atmospheres) on the piston downstroke while the piston crown is above the top of the transfer ports 50. This means that the piston acts like a positive-displacement supercharger during its combustion phase. The extremely high pressurization provides very high gas-flow velocities during the air transfer phase (Intake duration=82° Crank), which allows the use of very shallow transfer slots 50. This configuration is very well suited to burn CNG (natural Gas) or propane, because the cylinder wall does not require lubrication by gasoline fuel vapor. This embodiment also provides high power/torque output with gasoline or diesel fuels due to the supercharging effect.

Figure 7:
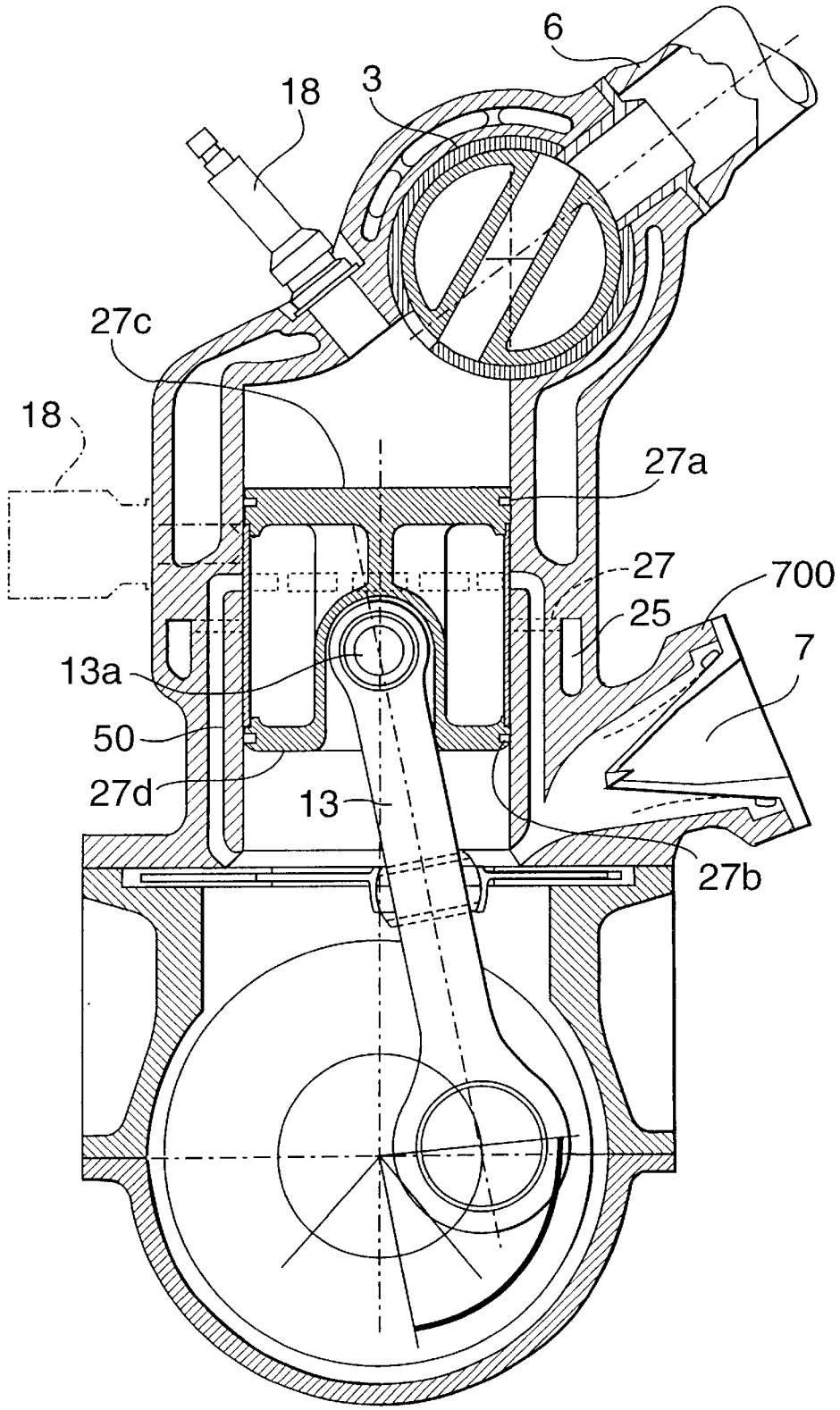
FIG. 7 is a vertical cross section of the engine block of the second embodiment with the piston at 85° crank angle.
Figure 8:
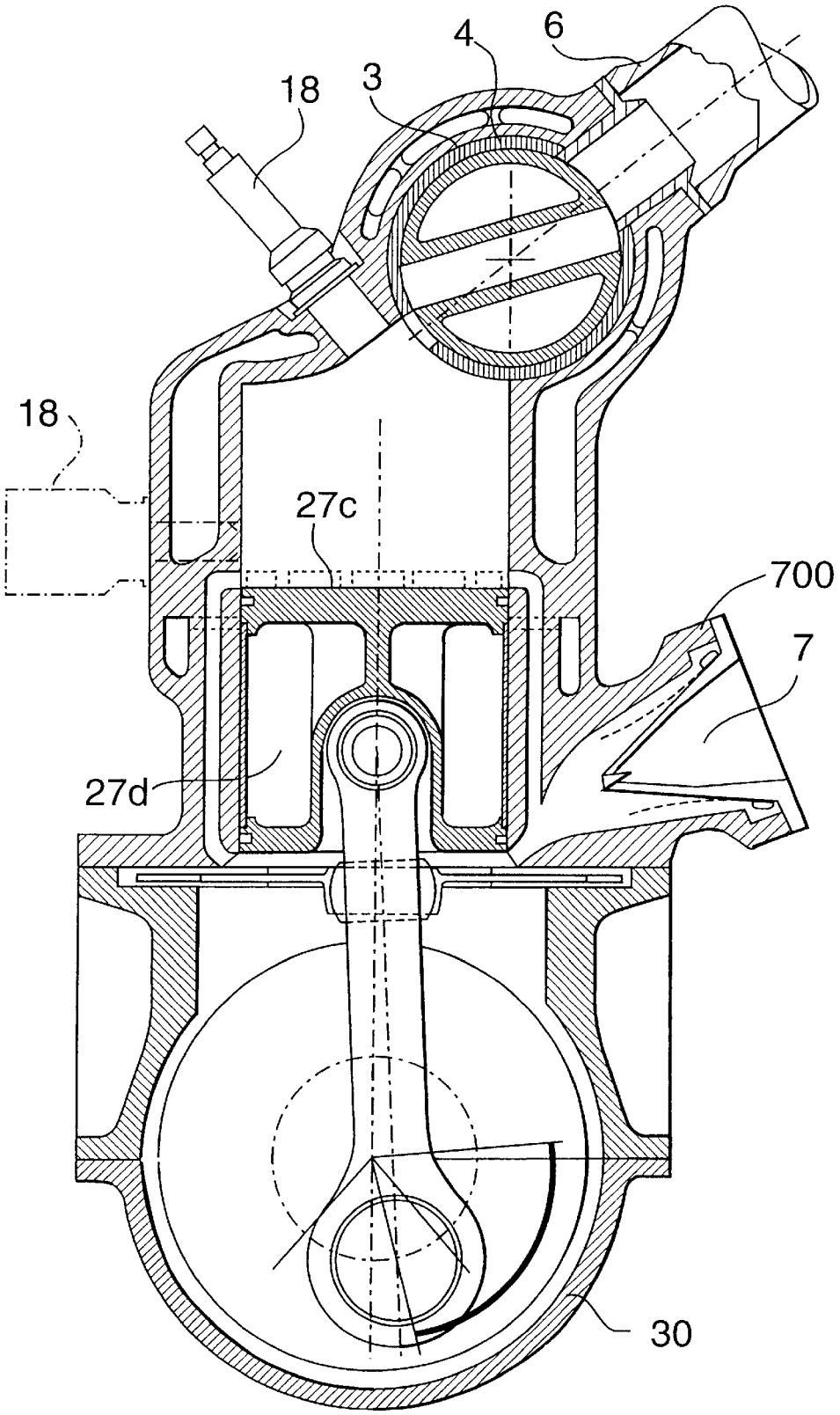
FIG. 8 is a vertical cross section of the engine block of the second embodiment with the piston at 170° crank angle.
Figure 9:
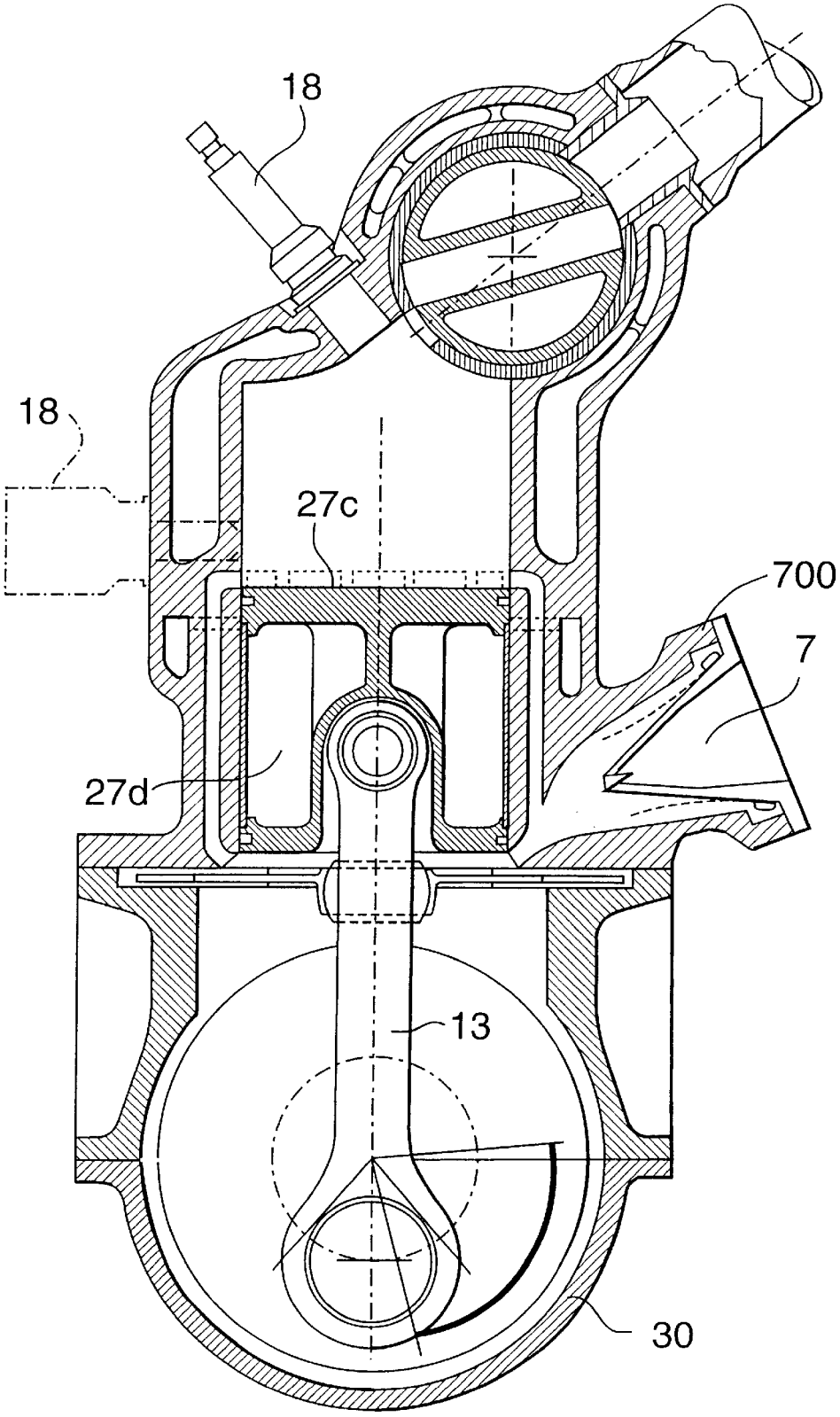
FIG. 9 is a vertical cross section of the engine block of the second embodiment with the piston at bottom dead center (BDC)
Figure 10:
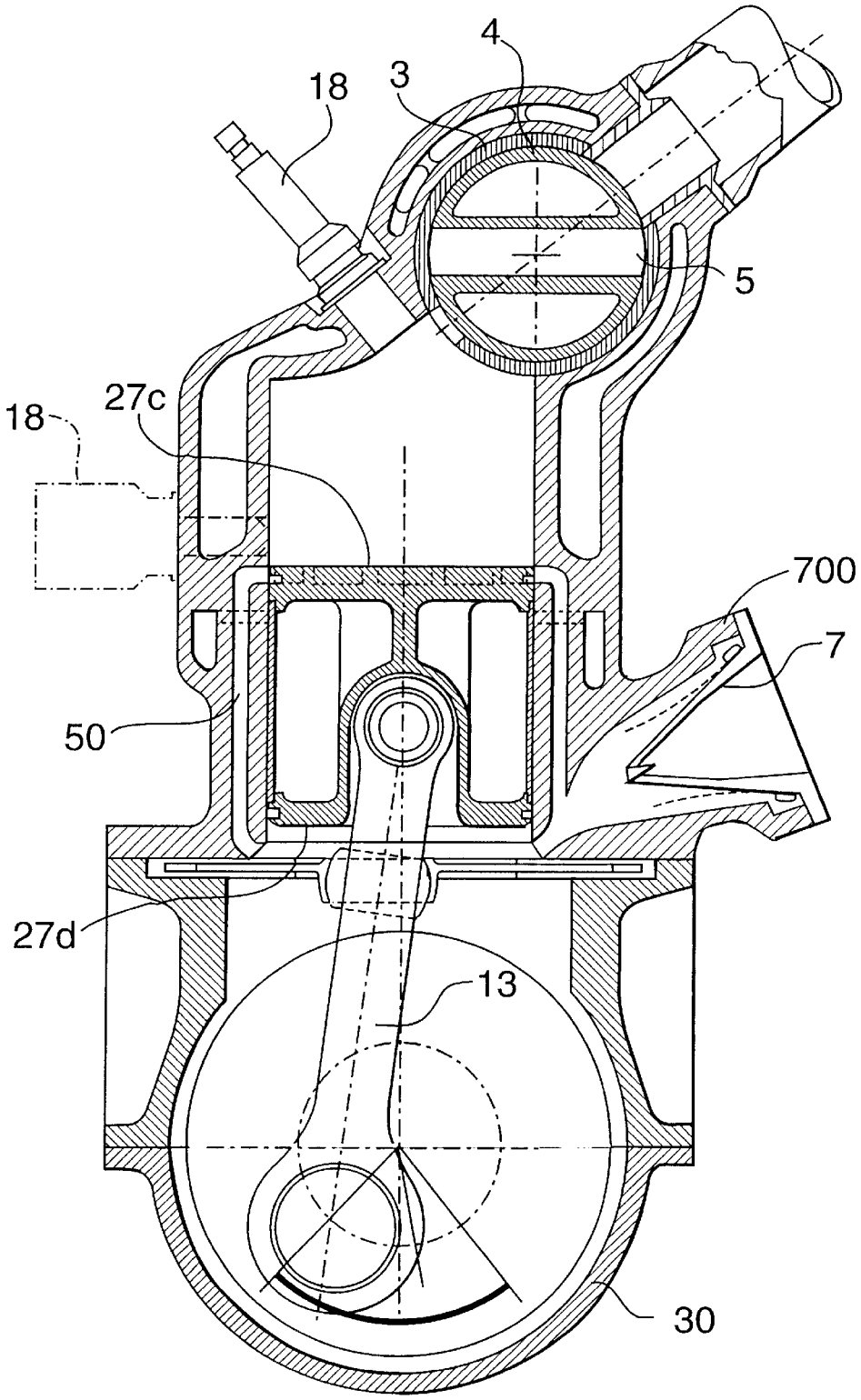
FIG. 10 is a vertical cross section of the engine block of the second embodiment with the piston at 221° crank angle.

As shown in the first embodiment, the exhaust port begins to open at 85° crank angle (FIG. 7) and is closed by 170° angle (FIG. 8). The crown 27*c* of the piston 27 just exposes the tops of the transfer ports 50 when the piston 27 is at bottom dead centre (FIG. 9), by which time the exhaust port 4 is closed. The piston crown 27*c* then closes off the transfer ports at 221° crank angle as shown in FIG. 10.

Figure 12:
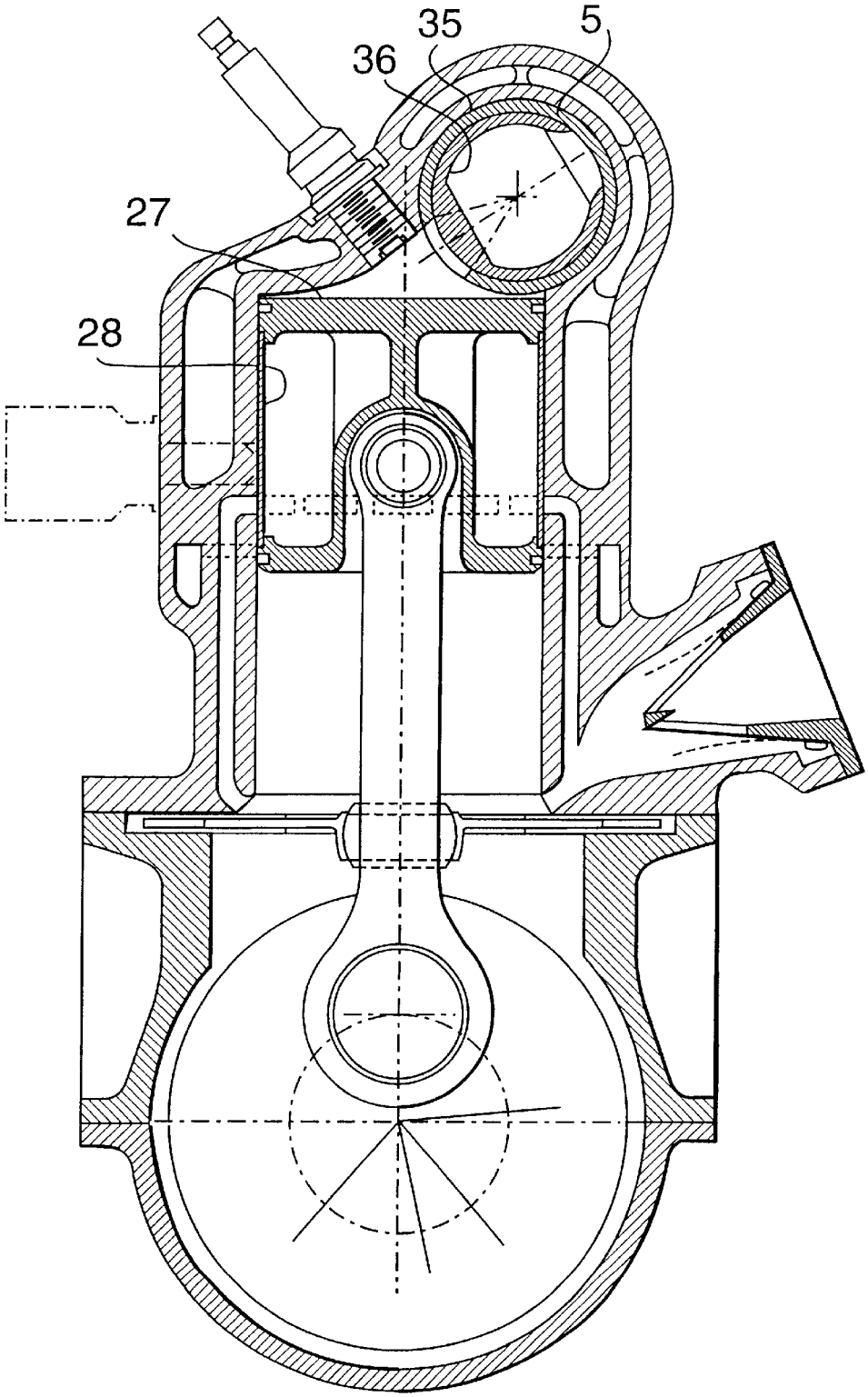
FIG. 12 is a vertical cross section through an engine block with the piston at top dead center (TDC) in accordance with a third embodiment of the invention.

The third embodiment shown in FIG. 12 has a cross section similar to the second embodiment, except that the rotary valve 5 provides a tubular port extending across the top of the piston. The rotary valve body 36 revolves inside sealing sleeve 35 at a speed equal to crank-shaft speed. The piston and its related breathing cycle is similar to the second embodiment except that the exhaust gases are discharged laterally through the sleeve 35 when the port 5 is open.

Figure 13:
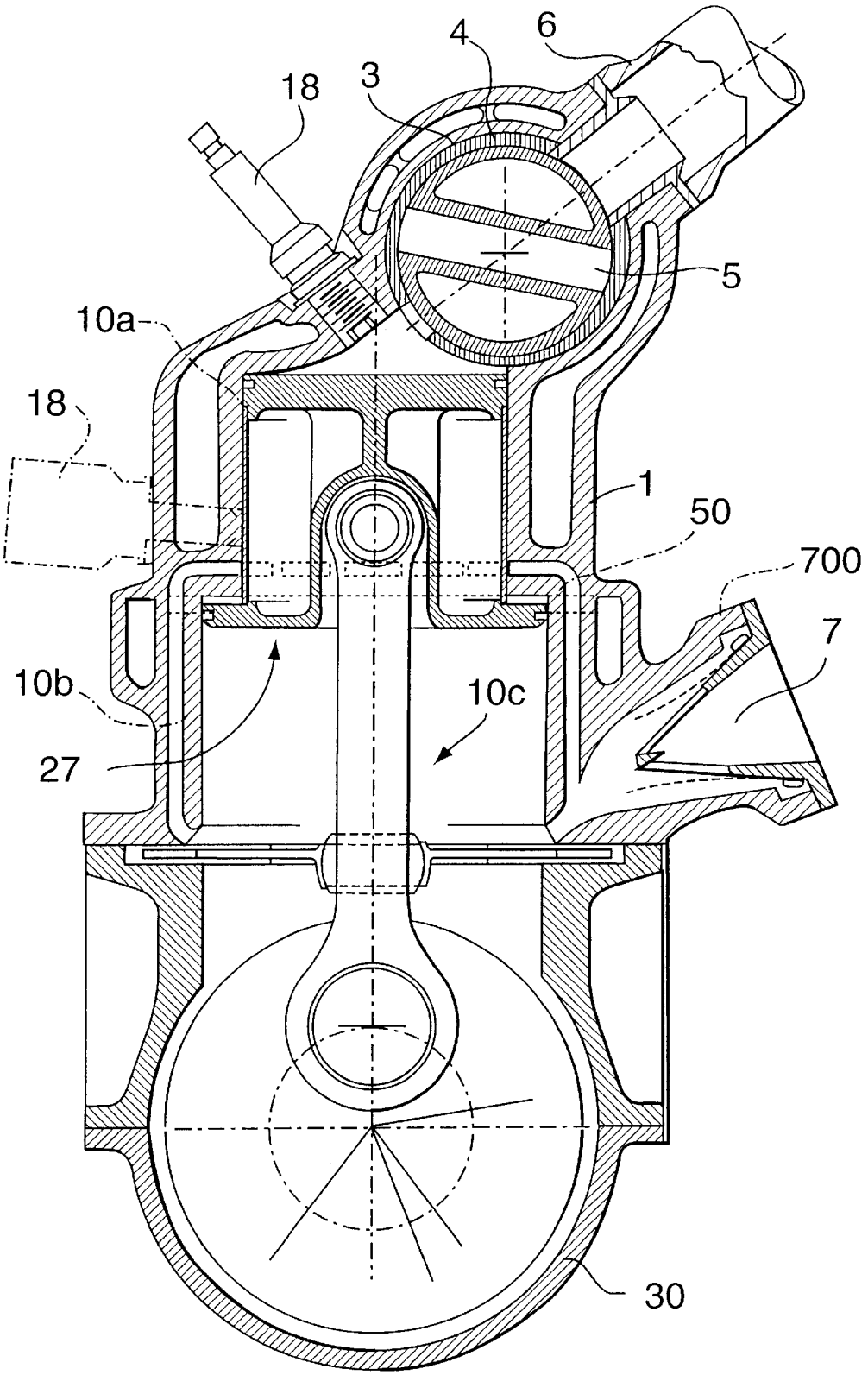
FIG. 13 is a vertical cross section through an engine block with the piston at top dead center (TDC) in accordance with a fourth embodiment of the invention.

The fourth embodiment shown in FIG. 13 has an upper cylinder wall 10*a* forming the combustion space and lower cylinder wall 10*b* forming a larger diameter (larger volume) intake space 10*c* below the piston. Cylinder 10 has narrow transfer slots 50 similar to the third embodiment.

As in the second and third embodiments, the piston 27 has a double face construction, consisting of a crown plate 27*a* and a larger diameter base plate 27*b*. The crown plate and the base plate are connected by a tubular web structure 27*c*, which also provides twin bores to carry the piston wrist-pin 13*a*.

The membrane crankcase barrier module 22 is the same as described before. The bottom plate 27*b* of the piston compresses the ingested intake air against the membrane crankcase barrier at approx. 6:1 ratio (net 5 atmospheres). Since the lower cylinder space 10*c* has a larger diameter than the upper cylinder space, the intake volume can be up to twice that of the combustion volume above the piston. This provides an overfilling (supercharging effect) when the high-velocity transfer air fills the combustion space. While this transfer is taking place the exhaust rotary valve 5 is closed for most of the time, except for the initial 15° Crank of the transfer phase. In this embodiment, the rotary valve 5 starts to open at 80° crank angle and is closed by 160° crank angle. There is 15° degree overlap so that the piston crown 27*c* starts to expose the tops of the transfer ports 50 15° of crank angle before the rotary valve 5 is fully closed. As in the previous embodiments, the transfer ports 50 are closed on the upstroke by 221° crank angle.

Figure 14:
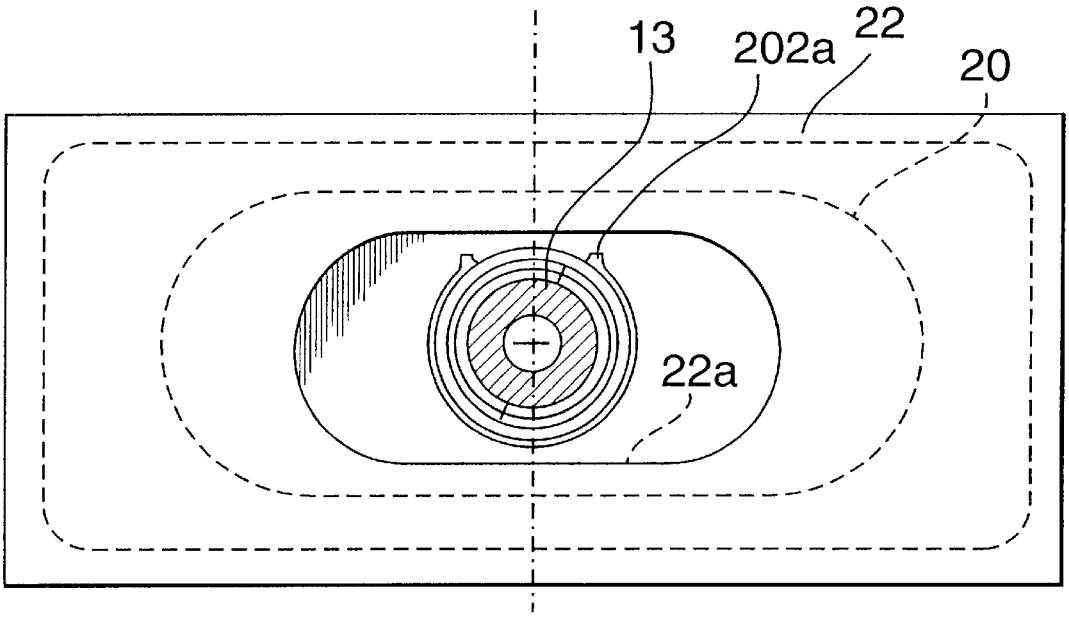
FIG. 14 is a plan view of a membrane barrier module.

FIG. 14 shows in more detail the basic construction of the membrane crankcase barrier 20 and associated components. The membrane barrier case 22 is in the form of a shallow box with a central aperture 22 to permit the ball-and-socket coupling to be displaced laterally during angular motion of the piston 12.

Figure 15:
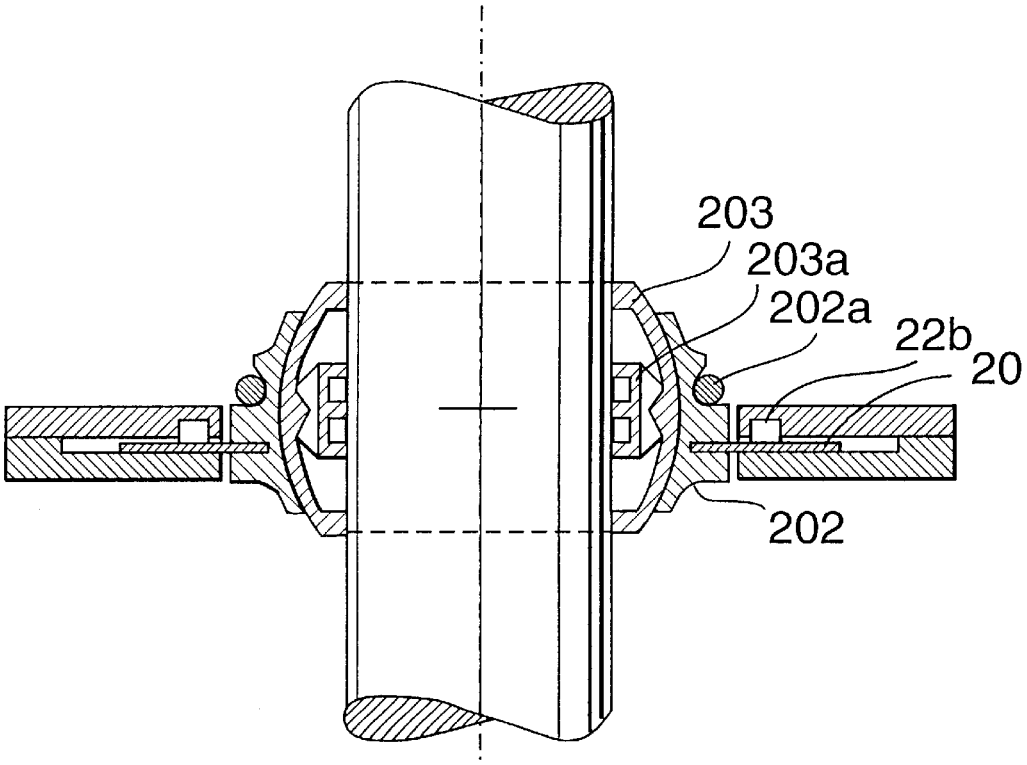
FIG. 15 is a cross section of a membrane barrier module.

The ball collar 203 shown in FIG. 15 is a split spherical collar surrounding the connecting rod 13, which contains a split insert labyrinth type seal collar 203*a*.

The spherical collar 203 swivels inside a split socket 202, which is clipped together by a sprung clip 202*a*. The split socket 202 is attached to the slide membrane 20, which slides inside the slotted space provided in the barrier case 22.

The top portion of the barrier case carries 22 a seal ring 22*b* (silicon or similar) inside a groove. This seal ring 22*b* contacts the top surface of the slide membrane 20 to retain oil from the crankcase and prevent it flowing through into the cylinder space 10*c*.

Figure 17:
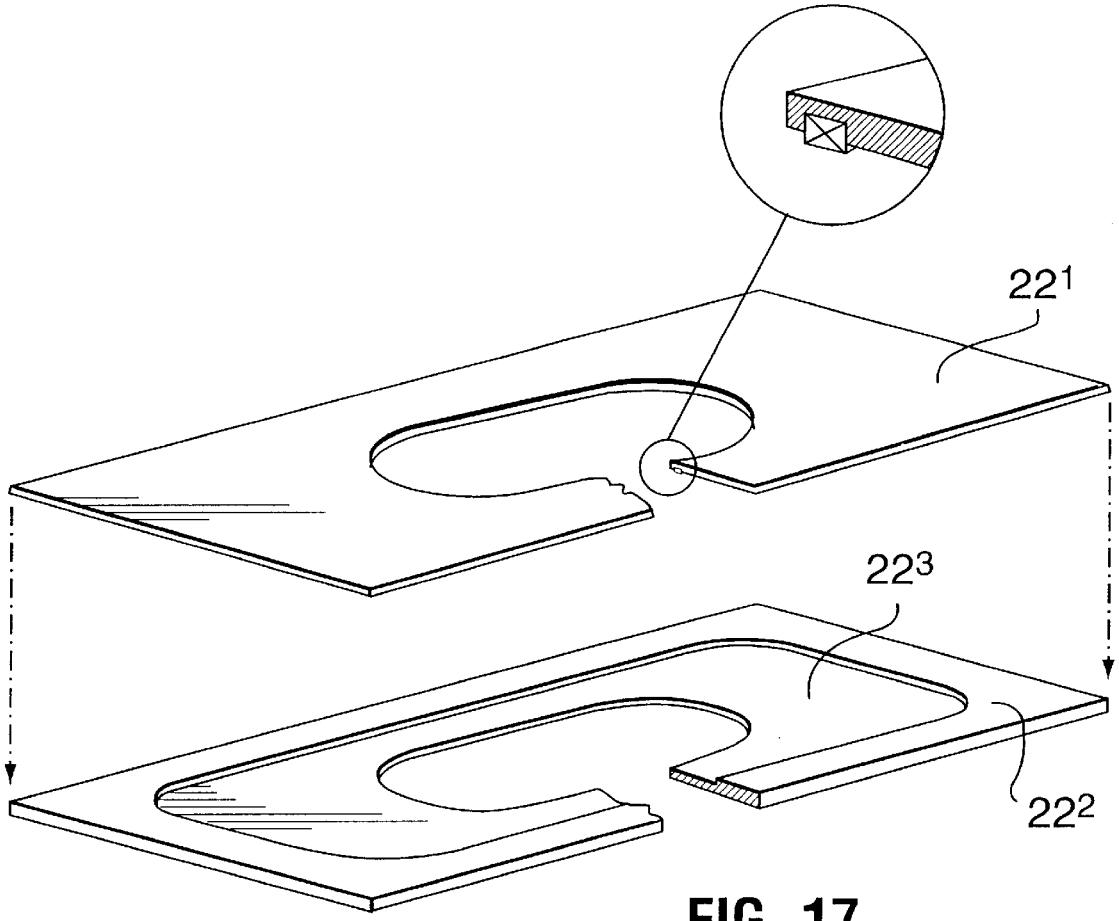
FIG. 17 is a perspective exploded view of an alternative membrane case (horizontal split)

FIG. 17 shows an alternate type of construction for the barrier casing 22. In this embodiment, the casing 22 consists upper and lower plates $\mathbf{22}_1$ and $\mathbf{22}_2$ held together by suitable attachment means. The lower plate $\mathbf{22}_2$ includes a recess $\mathbf{22}_3$ surrounding the central aperture that accommodates the membrane barrier 22.

Figure 18:
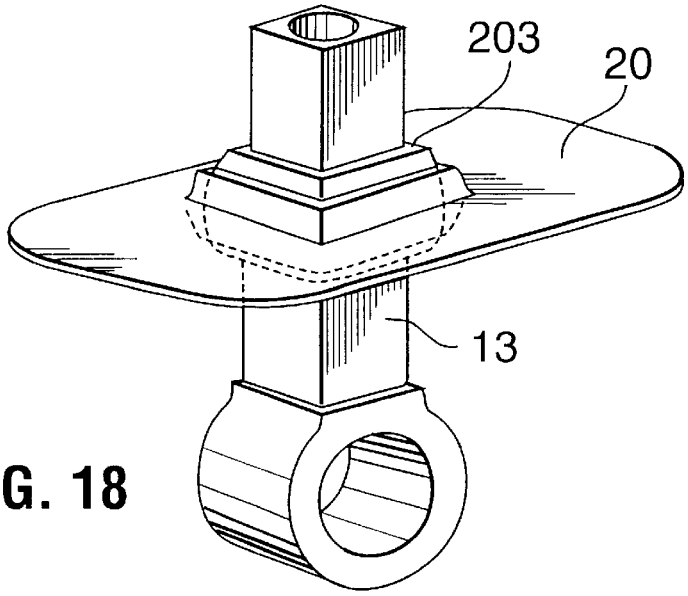
FIG. 18 is a perspective view of a rectangular cross-section connecting rod.
Figure 19:
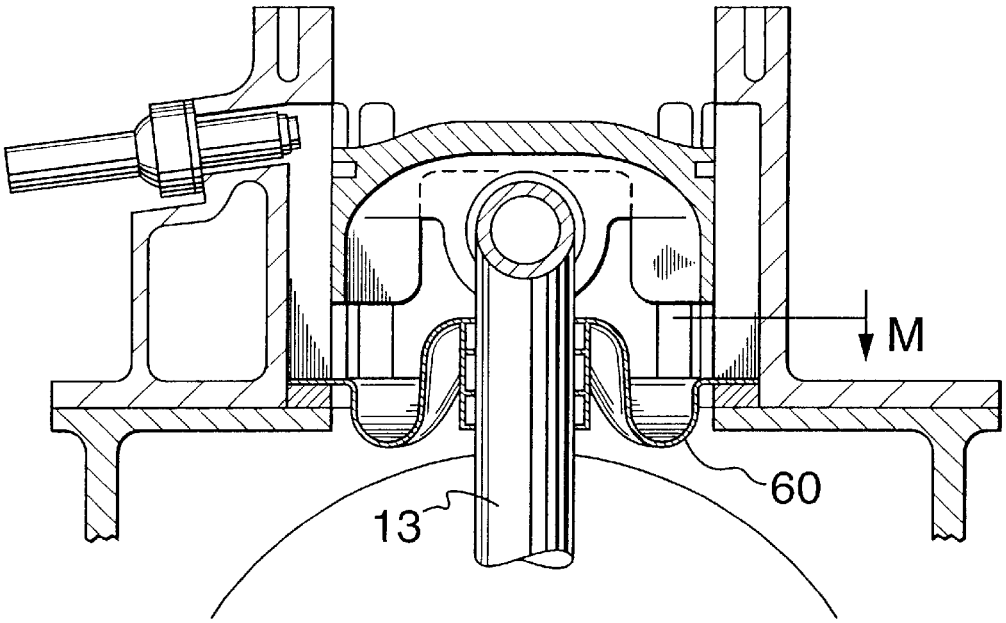
FIG. 19 is section through an alternative flexible type membrane module.
Figure 20:
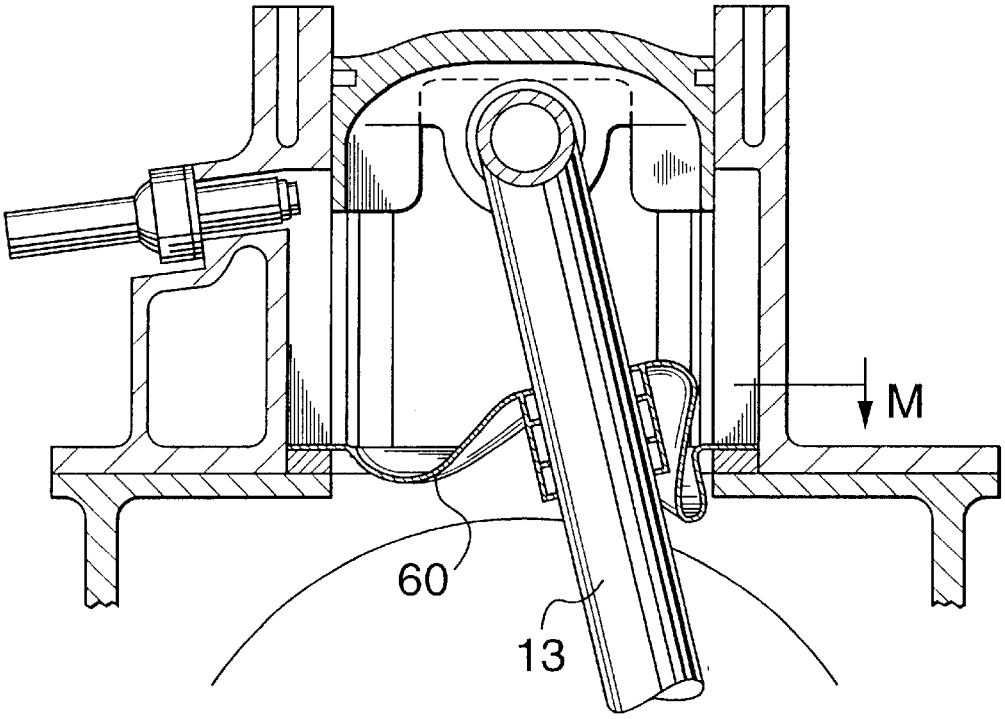
FIG. 20 is a section through the flexible-type membrane with the conrod in the angular position.

FIG. 18 shows an alternate rectangular cross-section connecting rod 13*a* with corresponding shapes of swivel collar 203 and slide membrane socket 20.

Another type of crankcase barrier is shown in FIGS. 19 to 22. This barrier utilizes a flexing membrane 60 of tough reinforced nylon, which resists the scavenging pressure of the intake air in tension. The membrane 60 is shaped so that the angular motion of the conrod 13 causes minimal stress in the material. The membrane is split into two equal halves, which are joined together around the conrod 13 during installation. Once joined together two small convex closure skins 61 are bonded into the two elliptical spaces on either side of the conrod collar. This membrane requires a plastic material, which possesses flexing and tensile capabilities to suit this function.

An important feature of this two-cycle engine is the overhead rotary valve 4. Rotary valves for gasoline engines are quite old in principle, originating in the 1920's. These devices are efficient in concept but never proved practical due to the lack of a reliable seal against combustion pressure. This invention shows a simple means to seal with minimal friction.

Figure 21:
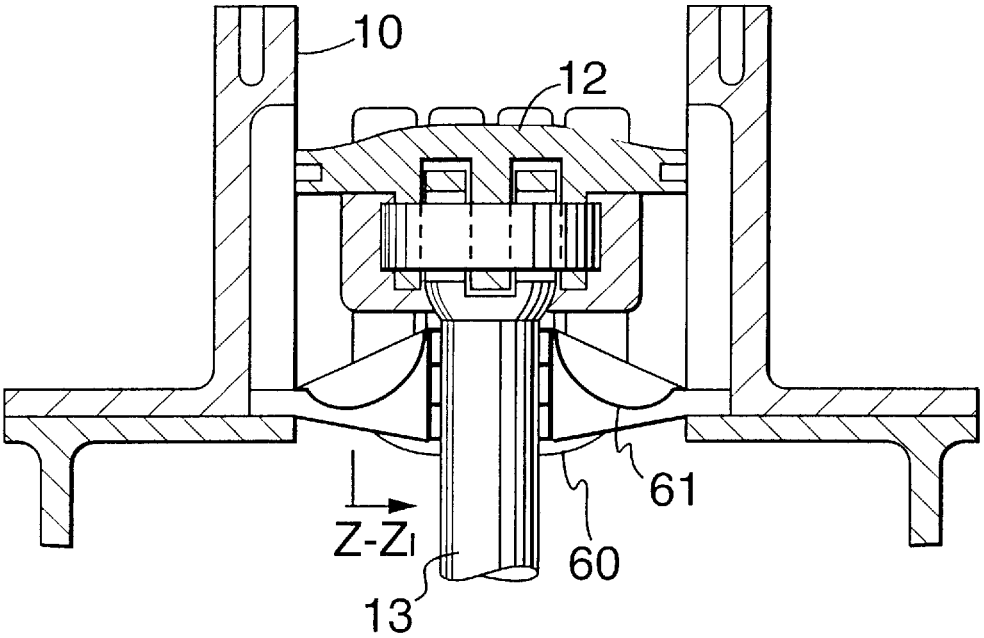
FIG. 21 is a section taken at right angles to the section in FIG. 19.

As shown in FIG. 21, the rotary valve body 4 contains a port slot 5, which traverses the centre of the cylindrical valve body 4. The valve body 4 rotates at half crankshaft speed. The valve body 4 is carried in bearings at both ends. For multiple cylinders in-line intermediate bearings or bushings are provided to locate this rotary valve body. The valve body 4 is preferably made of a temperature-stable ceramic material or metal-matrix, and is surrounded by a cylindrical carbon sleeve 3. The sleeve may also be metal matrix alloy coated with a ceramic or carbon compound to provide self-lubricating qualities.

Figure 22:
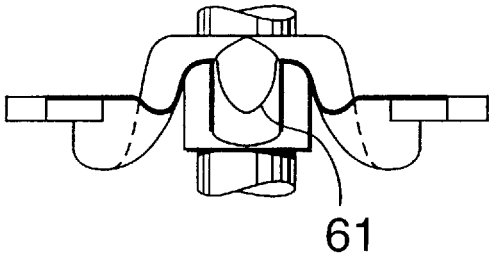
FIG. 22 is a section taken at right angles to the section in FIG. 20.
Figure 23:
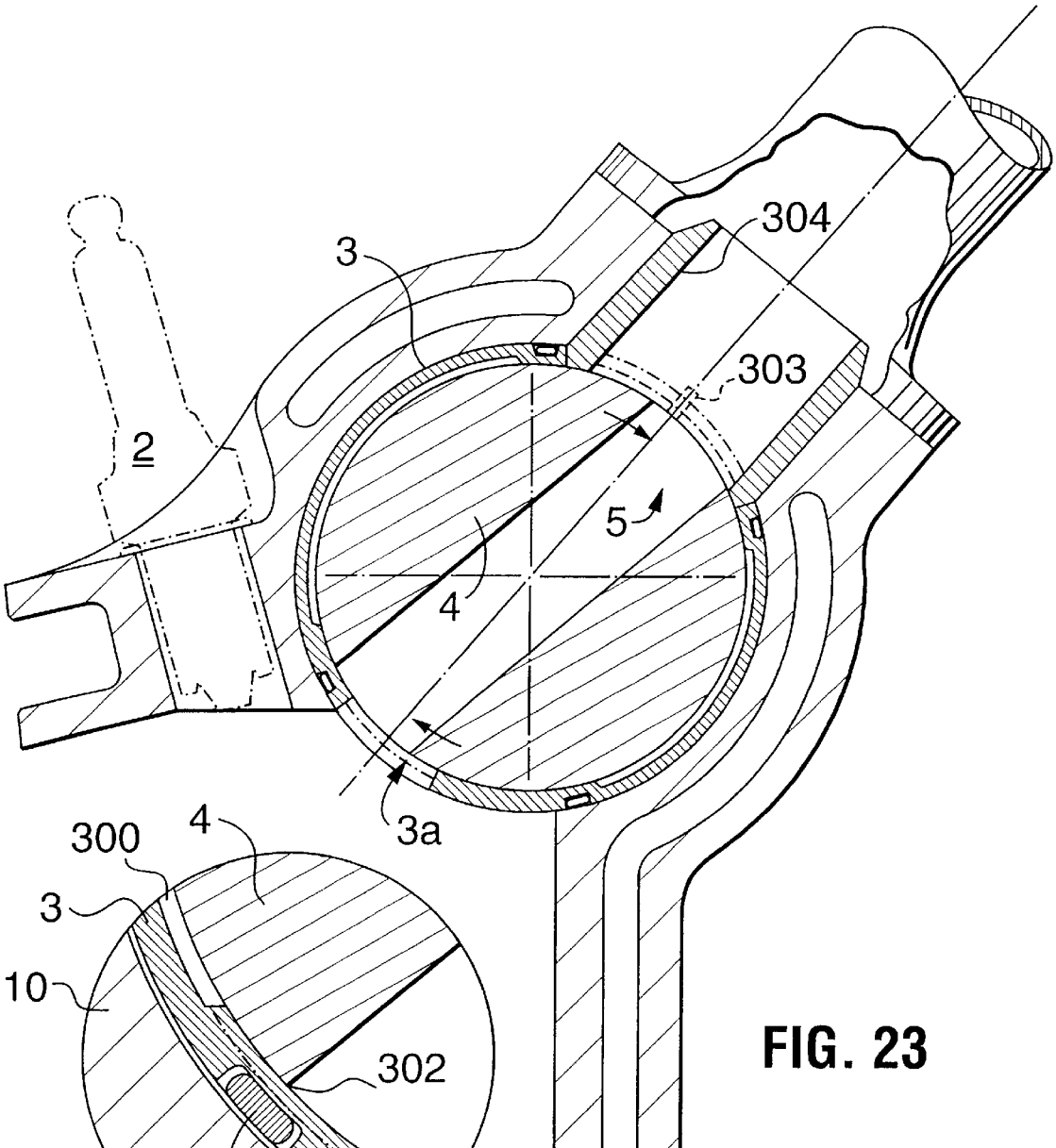
FIG. 23 is a cross-sectional view of a rotary valve stem.
Figure 24:
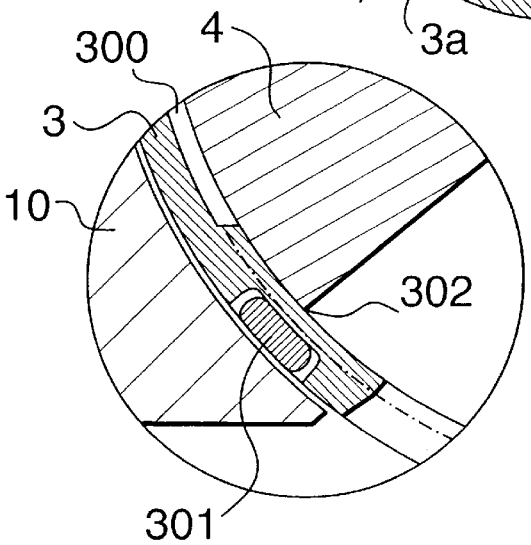
FIG. 24 shows a detail of a sealing grid.

The sleeve 3 has a split 303 along its top centre-line, at both sides of the port collar 304, which also anchors the sleeve to avoid rotation. The sleeve 3 is fitted with an exhaust opening 3*a*, which corresponds with port 5 in the rotary valve body 4. The exhaust opening 3*a* is ringed by a compressible (silicon) ring 301 in a groove on the outer surface of the carbon sealing sleeve 3. Combustion pressure causes the sleeve to be pressed against the rotary valve body 4 to create a sealing joint 302 (FIG. 22). As the sleeve rides up toward the rotary valve body 4, the outer space between the sleeve 3 and the engine block 1 is sealed by the silicon ring 301. The outer surface of sleeve 3 may be in direct contact with the cooling water in the engine block. The interior surface of the sleeve is fitted with a specially shaped relief space 300 to ensure minimum friction contact against the rotary valve body 4.

No oil lubrication is required on the inside surface of the sleeve 3. The gases provide the necessary film between the self-lubricating ceramic and carbon materials. The relief space 300 is vented back to an external vent space, to collect any minute gas particles, which have bypassed the sealing joint 302.

Figure 25:
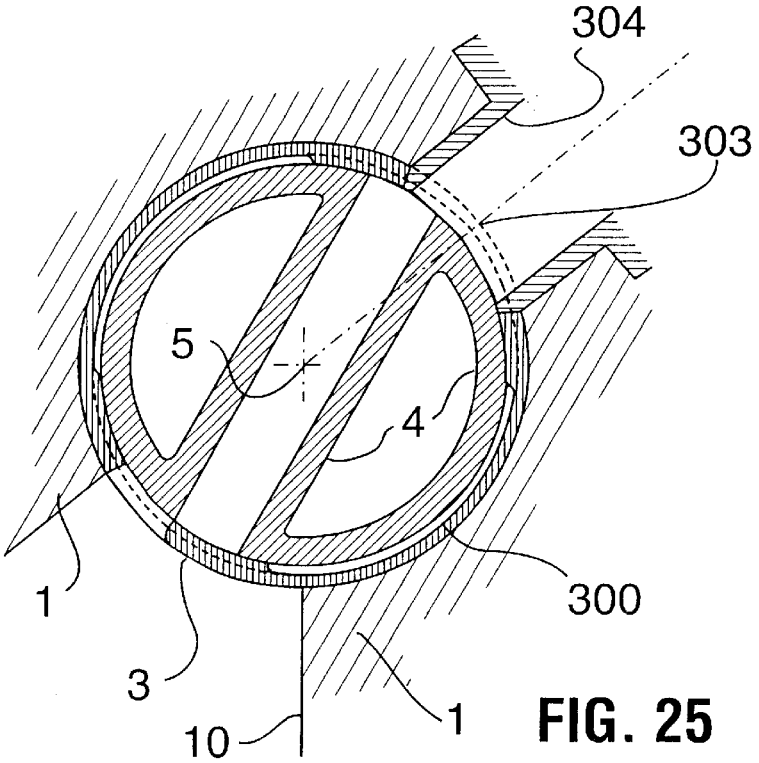
FIG. 25 is a cross section through the rotary valve of the first, second and fourth embodiments.
Figure 26:
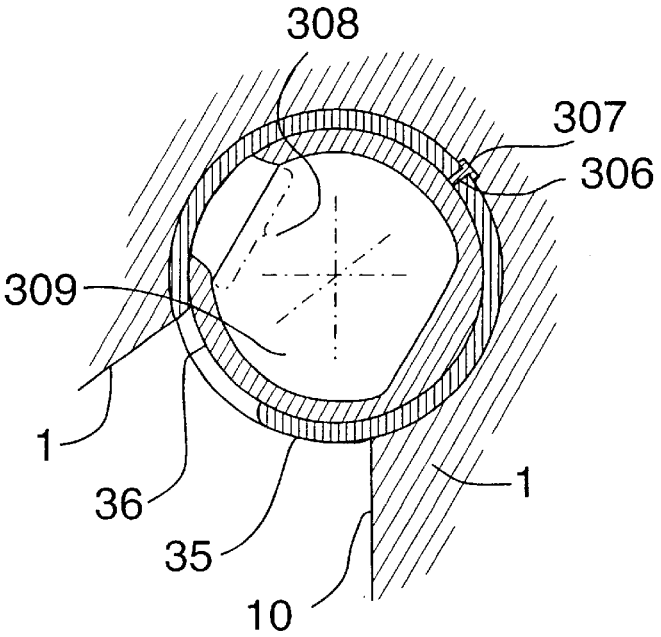
FIG. 26 is a cross section through the rotary valve of the third embodiment.

The rotary valve shown in FIG. 25 features a single port opening 308 and an adjoining tubular port 309. This type rotates at full crankshaft speed. The rotary valve body 306 is surrounded by a cylindrical sleeve 35 similar to that in FIG. 21. The sleeve 35 is split along one side with an inserted lock spline to secure the sleeve to the engine block 1.

It is noted that the above rotary valve system, especially as described with reference to FIGS. 23 to 26 can also be applied to four-cycle engines, instead of the usual overhead camshafts and poppet valves.

The above engine design can be used in a wide variety of applications and offers an effective means of benefiting from some of the advantages of two-stroke engines without the associated disadvantages.

I claim:

1. An internal combustion engine comprising:

a cylinder having a cylinder wall and a longitudinal axis;

a crankcase;

a crankshaft rotatable in said crankcase;

a piston mounted on a connecting rod supporting said piston for reciprocating movement in said cylinder, said connecting rod being mounted on said crankshaft;

a barrier member extending around said connecting rod to sealingly separate said cylinder from said crankcase throughout a complete crankshaft cycle, said barrier member being laterally displaceable to provide for angular motion of the connecting rod as said piston reciprocates in said cylinder;

an intake port including a non-return valve located above said barrier member, said intake port leading to a first space below said piston;

a row of transfer ports circumferentially spaced around said cylinder wall to establish communication between said first space and a second space above said piston over a limited range of the piston stroke such that intake air drawn through said intake port is first compressed in said first space during the downstroke of the piston and subsequently enters said second space through said transfer ports and to collide in the center of the cylinder and form a turbulent vertical air column above said piston; and an overhead rotary exhaust valve offset relative to said longitudinal axis.

2. An internal combustion engine as claimed in claim 1, wherein said barrier member comprises a laterally slidable plate attached to said connecting rod by a pivoting sealing collar.

3. An internal combustion engine as claimed in claim 2, wherein said sealing collar forms the socket of a socket-and-ball coupling, the ball being formed on the connecting rod.

4. An internal combustion engine as claimed in claim 2, wherein a shallow recess is formed in the wall of the engine between the crankcase and cylinder, and said plate is slidably located in said shallow recess to permit lateral movement thereof.

5. An internal combustion engine as claimed in claim 1, wherein said barrier membrane comprises a flexible membrane sealed to said connecting rod and the wall of said cylinder.

6. An internal combustion engine as claimed in claim 1, wherein said transfer ports comprise shallow grooves formed in the wall of the cylinder, said grooves being exposed in said second space by said piston during the lower part of its stroke.

7. An internal combustion engine as claimed in claim 1, wherein said transfer ports comprise channels formed in the wall of the cylinder.

8. An internal combustion engine as claimed in claim 1, wherein said piston is a double-faced piston having upper and lower piston surfaces and upper and lower sealing rings sealing said respective surfaces to the wall of the cylinder.

9. An internal combustion engine as claimed in claim 8, wherein vent means are provided in the cylinder wall to supply oil to the piston wall between upper and lower piston rings.

10. An internal combustion engine as claimed in claim 1, wherein the cylinder has a larger diameter in said first space than said second space.

11. An engine as claimed in claim 1, wherein the open phase of said overhead rotary exhaust valve is timed to partly overlap the opening of the transfer ports.

12. An engine as claimed in claim 11, wherein said overhead rotary exhaust valve is open for about the first 15° of crank angle that the transfer ports are open.

13. An engine as claimed in claim 11, wherein said rotary valve comprises a transfer bore that is aligned with opposing holes in a retaining sleeve when the valve is open, said rotary valve being timed to rotate at half crankshaft speed.

14. An engine as claimed in claim 13, wherein said rotary valve comprises a tubular member with an opening that is aligned with an aperture in a retaining sleeve when the valve is open so as to discharge exhaust gases laterally through said tube, said rotary valve being timed to rotate at full crankshaft speed.

15. An engine as claimed in claim 1, wherein said rotary valve comprises a transverse retaining sleeve having a valve opening intended to be exposed to said cylinder, a compressible sealing ring around said opening, a tubular member rotatable in said retaining sleeve in synchronism with the engine, an opening in said tubular member that is aligned with said valve opening over a part of a revolution of the valve member when the valve is open, and channel means in said tubular member for carrying gases flowing through said valve opening.

16. An engine as claimed in claim 15, wherein said retaining sleeve has a second opening in opposing relationship to said first opening, and said channel means comprises a transverse bore in said tubular member that establishes communication between said first and second openings in the open condition of the valve.

17. An engine as claimed in claim 15, wherein said tubular member is hollow and said channel means comprises the interior of said tubular member, said gases being carried along the axis thereof.

18. An internal combustion engine comprising a cylinder, a crankcase, a crankshaft rotatable in said crankcase, a piston, and a connecting rod supporting said piston for reciprocating movement in said cylinder and mounted on said crankshaft, wherein a barrier member extends around said connecting rod to sealingly separate said cylinder from said crankcase throughout a complete crankshaft cycle, said barrier member being laterally displaceable to provide for angular motion of the connecting rod as said piston reciprocates in said cylinder, an intake port above said barrier member for the intake of air into a first space below said piston during the upstroke of the piston, a non-return valve in said intake port, a row of circumferentially spaced transfer ports establishing communication between said first space and a second space above said piston over a limited range of the piston stroke to permit air compressed during the downstroke of the piston to enter said second space and collide in the center of the cylinder and form a turbulent vertical air column, and an overhead rotary exhaust valve offset relative to the longitudinal axis of the cylinder and timed so that said compressed intake air forced through said transfer ports scavenges burned gases in the combustion chamber on the upstroke.

* * * * *